US007882826B2

(12) United States Patent
Prior

(10) Patent No.: US 7,882,826 B2
(45) Date of Patent: Feb. 8, 2011

(54) TAPERED ROTOR ASSEMBLIES FOR A SUPERCHARGER

(75) Inventor: Gregory P. Prior, Birmingham, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 400 days.

(21) Appl. No.: 11/751,191

(22) Filed: May 21, 2007

(65) Prior Publication Data

US 2008/0292487 A1 Nov. 27, 2008

(51) Int. Cl.

| | |
|---|---|
| ***F02B 33/00*** | (2006.01) |
| ***F01C 1/08*** | (2006.01) |
| ***F01C 1/16*** | (2006.01) |
| ***F01C 1/24*** | (2006.01) |
| ***F01C 1/18*** | (2006.01) |
| ***F04C 18/00*** | (2006.01) |
| ***F04C 2/00*** | (2006.01) |

(52) U.S. Cl. ..... 123/559.1; 418/201.1; 418/206.1; 418/206.5; 418/194

(58) Field of Classification Search ..... 123/559.1; 418/201.1, 206.1, 206.4, 206.5, 194
See application file for complete search history.

(56) References Cited

U.S. PATENT DOCUMENTS

| | | | | |
|---|---|---|---|---|
| 3,179,330 | A * | 4/1965 | Maccoll | 418/194 |
| 3,180,559 | A * | 4/1965 | Boyd | 418/194 |
| 4,453,901 | A * | 6/1984 | Zimmerly | 418/206.1 |
| 4,475,878 | A * | 10/1984 | Kasuya et al. | 418/201.3 |
| 4,522,576 | A * | 6/1985 | Carre et al. | 418/194 |
| 4,963,079 | A * | 10/1990 | Fujiwara et al. | 418/194 |
| 6,176,694 | B1 * | 1/2001 | Fang et al. | 418/194 |
| 6,589,034 | B2 * | 7/2003 | Vorwerk et al. | 418/206.4 |
| 6,884,050 | B2 | 4/2005 | Prior | 418/206.4 |
| 7,150,611 | B2 * | 12/2006 | Perna | 418/194 |
| 2008/0060623 | A1 * | 3/2008 | Prior | 123/559.1 |
| 2008/0170958 | A1 | 7/2008 | Prior | 418/179 |
| 2008/0175739 | A1 * | 7/2008 | Prior | 418/201.1 |

FOREIGN PATENT DOCUMENTS

| | | | |
|---|---|---|---|
| DE | 19728434 | A1 * | 1/1999 |
| WO | WO 0161151 | A1 * | 8/2001 |

* cited by examiner

*Primary Examiner*—Thai Ba Trieu
(74) *Attorney, Agent, or Firm*—Quinn Law Group, PLLC

(57) ABSTRACT

A rotor assembly is provided for a compressor assembly having a housing defining an inlet port, outlet port, and a rotor cavity in communication with the inlet port and outlet port. The rotor assembly includes a rotor body having a plurality of lobes formed thereon and rotatably mountable within the rotor cavity of the housing. The rotor body has a first end, substantially adjacent to the inlet port, and a second end, substantially adjacent to the outlet port, when mounted within the housing. Each of the plurality of lobes has an outer radius that is greater at the first end than at the second end.

20 Claims, 3 Drawing Sheets

TAPERED ROTOR ASSEMBLIES FOR A SUPERCHARGER

TECHNICAL FIELD

The present invention relates to rotor assemblies having a generally tapering shape for use within a supercharger assembly.

BACKGROUND OF THE INVENTION

Roots-type and screw-type positive displacement compressors are employed in industrial and automotive applications. The compressor or supercharger may be operatively connected to an internal combustion engine to increase the amount or volume of intake air communicated to the internal combustion engine thereby increasing the volumetric efficiency thereof. The supercharger typically includes two interleaved and counter-rotating rotors each of which may be formed with a plurality of lobes to convey volumes of intake air from an inlet passage to an outlet passage for subsequent introduction to the internal combustion engine. The efficiency of the supercharger is dependent on the running clearances between each of the two rotors and a housing within which the two rotors are rotatably supported.

SUMMARY OF THE INVENTION

A rotor assembly is provided for a compressor assembly having a housing defining an inlet port, outlet port, and a rotor cavity in communication with the inlet port and outlet port. The rotor assembly includes a rotor body having a plurality of lobes formed thereon and rotatably mountable within the rotor cavity of the housing. The rotor body has a first end, substantially adjacent to the inlet port, and a second end, substantially adjacent to the outlet port, when mounted within the housing. Each of the plurality of lobes has an outer radius that is greater at the first end than at the second end.

The outer radius may generally taper from the first end to the second end. Alternatively, the outer radius may generally taper from a point between the first and second end to the second end. A compressor assembly incorporating the rotor assembly is also disclosed.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
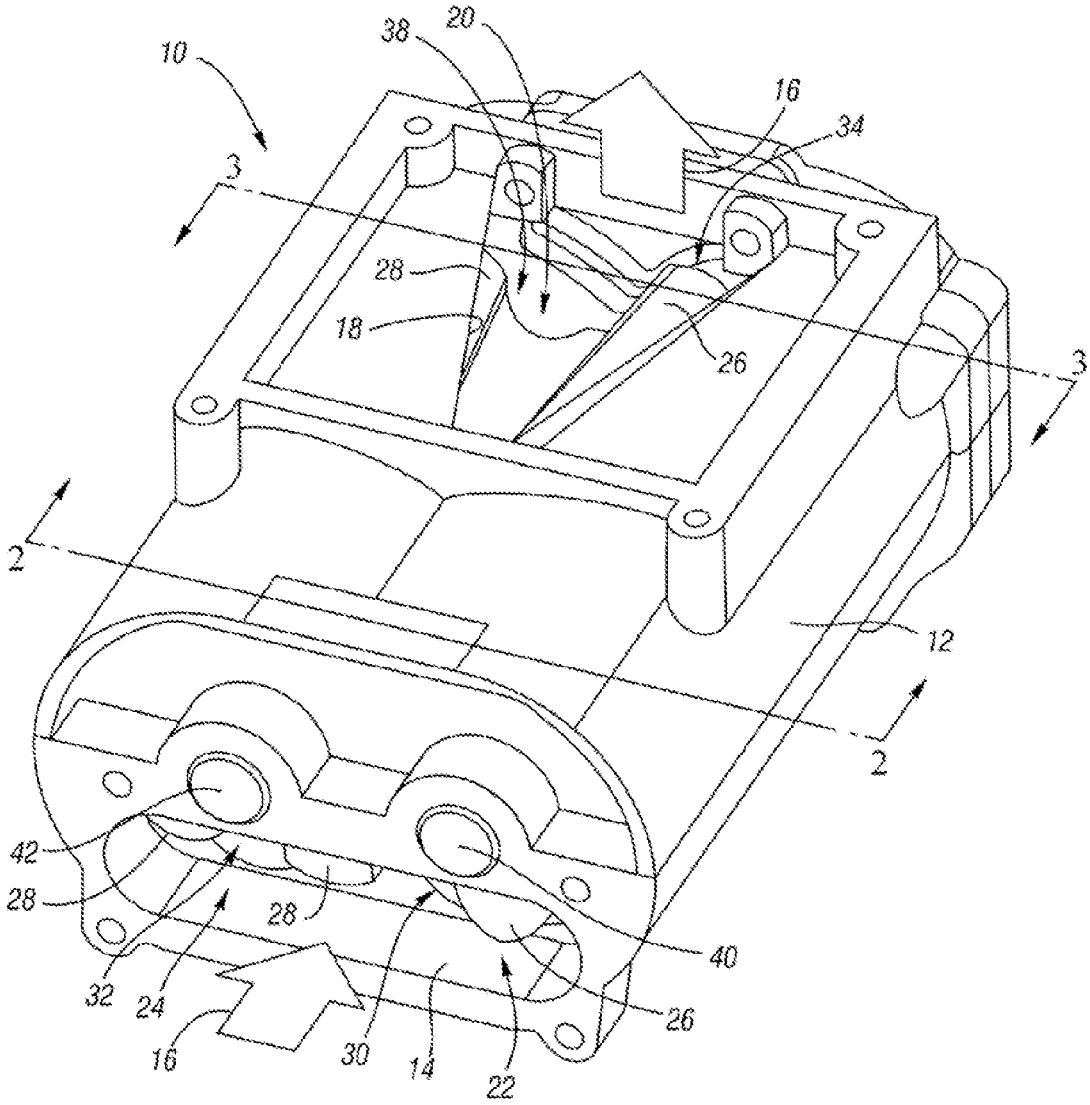
FIG. 1 is a schematic perspective view of a supercharger assembly configured for use with an internal combustion engine.

Referring to the drawings wherein like reference numbers correspond to like or similar components throughout the several figures, there is shown in FIG. 1 a compressor or supercharger assembly, generally indicated at 10. The supercharger 10 includes a housing 12. The housing 12 defines an inlet passage 14 configured to induct intake air, represented by arrow 16, into the supercharger assembly 10. The housing 12 further defines an outlet passage 18 configured to exhaust or expel the intake air 16 from the supercharger assembly 10.

A rotor cavity 20 is defined by the housing 12 and is configured to contain a first and second rotor assembly 22 and 24, respectively, rotatably disposed therein. The first and second rotor assemblies 22 and 24 are interleaved and counter-rotating. The first rotor assembly 22 includes a plurality of lobes 26 extending radially outward in a clockwise twisting helical shape, as viewed from the inlet passage 14, while the second rotor assembly 24 includes a plurality of lobes 28 extending radially outward in a counter-clockwise twisting helical shape, as viewed from the inlet passage 14. The first and second rotor assemblies 22 and 24 have first ends 30 and 32, respectively, disposed substantially adjacent to the inlet passage 14 and second ends 34 and 38, respectively, disposed substantially adjacent to the outlet passage 18. The first and second rotor assemblies 22 and 24 are rotatably supported within the rotor cavity 20 by a respective first and second shaft member 40 and 42. Those skilled in the art will recognize that the first and second rotor assemblies 22 and 24 may have screw-type lobes formed thereon while remaining within the scope of that which is claimed.

During operation of the supercharger assembly 10, the first and second rotor assemblies 22 and 24 cooperate to convey volumes of intake air 16 from the inlet passage 14 to the outlet passage 18. The temperature of the intake air 16 tends to increase as the intake air 16 is transferred from the inlet passage 14 to the outlet passage 18, thereby forming a thermal gradient along the longitudinal axis of the first and second rotors 22 and 24 from the respective first ends 30 and 32 to the respective second ends 34 and 38. As a result, the degree of thermal expansion of the first and second rotor assemblies 22 and 24 will increase from the first ends 30 and 32 and the second ends 34 and 38, thereby increasing the likelihood of "scuff" at the second ends 34 and 38 of the first and second rotor assemblies 22 and 24. Scuff is defined as metal transfer as a result of the first and second rotor assemblies 22 and 24 contacting one another or the housing 12.

Figure 2:
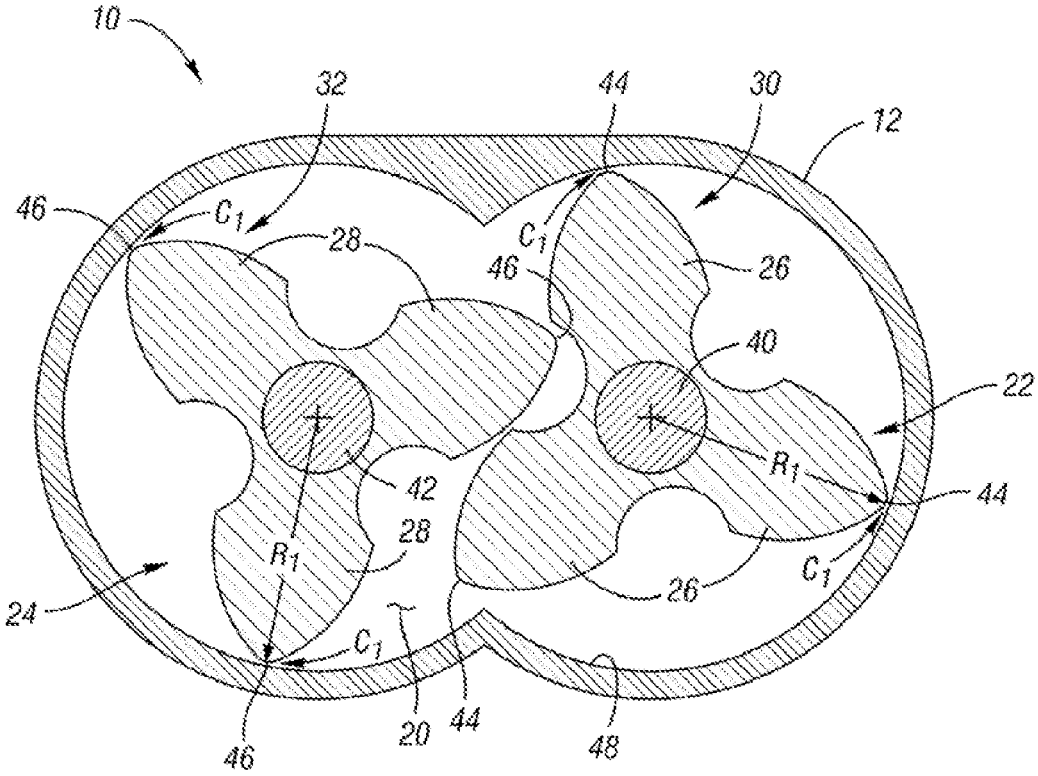
FIG. 2 is a schematic cross sectional view of the supercharger of FIG. 1 taken along line 2-2 of FIG. 1.
Figure 3:
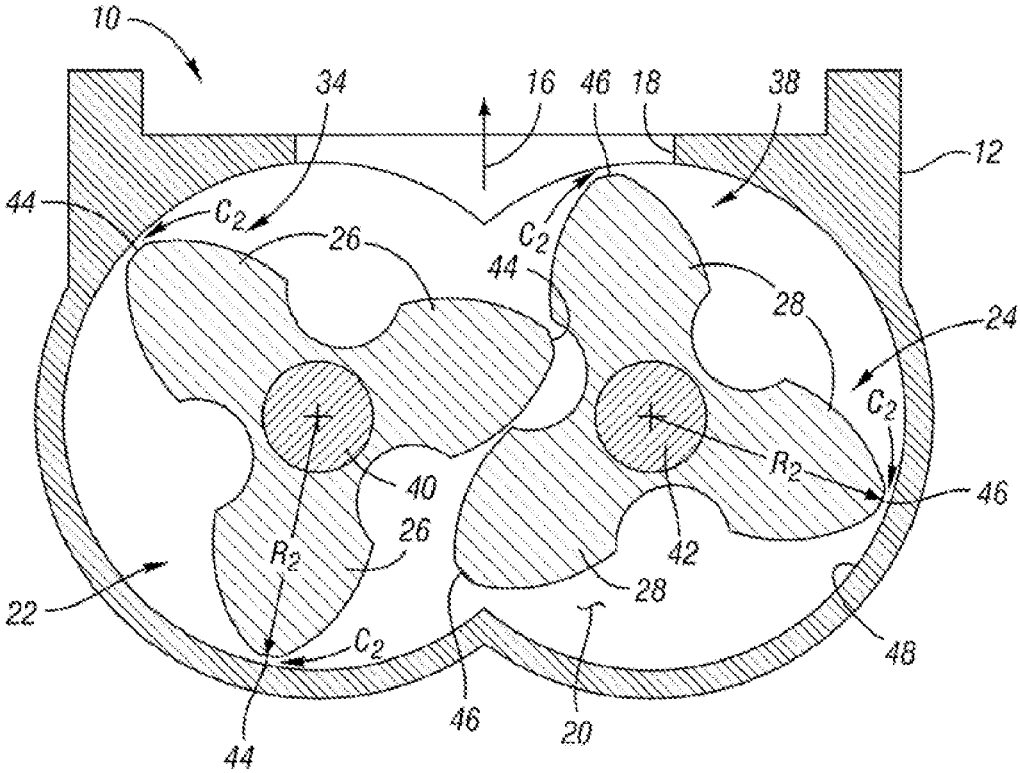
FIG. 3 is a schematic cross sectional view of the supercharger of FIG. 1 taken along line 3-3 of FIG. 1.

Referring to FIG. 2 and with continued reference to FIG. 1, there is shown a sectional view of the supercharger assembly 10 taken along line 2-2 of FIG. 1. Each of the plurality of lobes 26 and 28 include a tip portion 44 and 46, respectively, positioned at the outer extreme of the respective lobes 26 and 28. The rotor cavity 20, within which the first and second rotor assemblies 22 and 24 are disposed, is defined by an inner wall 48 of the housing 12. As illustrated in FIG. 2, each of the lobes 26 and 28 have an outer radius, indicated as $R_1$, at the first ends 30 and 32 of the respective first and second rotor assemblies 22 and 24. A gap or clearance, generally indicated as $C_1$, is provided between the tip portions 44 and 46 and the inner wall 48. Referring now to FIG. 3 and with continued reference to FIG. 1, there is shown a sectional view of the supercharger assembly 10 taken along line 3-3 of FIG. 1. As illustrated in FIG. 3, each of the lobes 26 and 28 have an outer radius, indicated as $R_2$ at the second ends 34 and 38 of the respective first and second rotor assemblies 22 and 24. A gap or clearance, generally indicated as $C_2$, is provided between the tip portions 44 and 46 and the inner wall 48. In a preferred embodiment, the outer radius of the lobes 26 and 28 generally tapers from the first ends 30 and 32 to the second ends 34 and 38 of the respective first and second rotor assemblies 22 and 24. That is, the outer radii $R_1$, of the lobes 26 and 28, at the first ends 30 and 32 is greater than the outer radii $R_2$, of the lobes 26 and 28, at the second ends 34 and 38 of the respective first and second rotor assemblies 22 and 24. As such, the clearance $C_1$ between the rotor tip portions 44 and 46 and the inner wall 48 at the first ends 30 and 32 of the first and second rotor assembly 22 and 24 is less than the clearance $C_2$ at the second ends 34 and 38 of the first and second rotor assemblies 22 and 24.

Referring to FIGS. 1 through 3, in operation, the intake air 16 will heat the first and second rotor assemblies 22 and 24 causing a greater thermal expansion at the second ends 34 and 38 than the first ends 30 and 32. By providing the first and second rotor assemblies 22 and 24 with a generally tapering shape, the clearance $C_1$ and $C_2$ during operation of the supercharger assembly 10 will substantially equalize. The generally tapered shape of the first and second rotor assemblies 22 and 24 enables a smaller or tighter clearance dimension $C_1$ at the first ends 30 and 32 of the first and second rotor assemblies 22 and 24, while substantially avoiding the possibility of scuff at the second ends 34 and 38 during operation of the supercharger assembly 10. The lobes 26 and 28 may taper continuously from the first ends 30 and 32 to the second ends 34 and 38 of the first and second rotor assemblies 22 and 24. Alternatively, the lobes 26 and 28 may taper from any point between the first and second ends 30, 32 and 34, 38 to the second ends 34 and 38 of the first and second rotor assemblies 22 and 24. The lobes 26 and 28 may taper in a generally linear or a curved fashion while remaining within the scope of that which is claimed.

Figure 4:
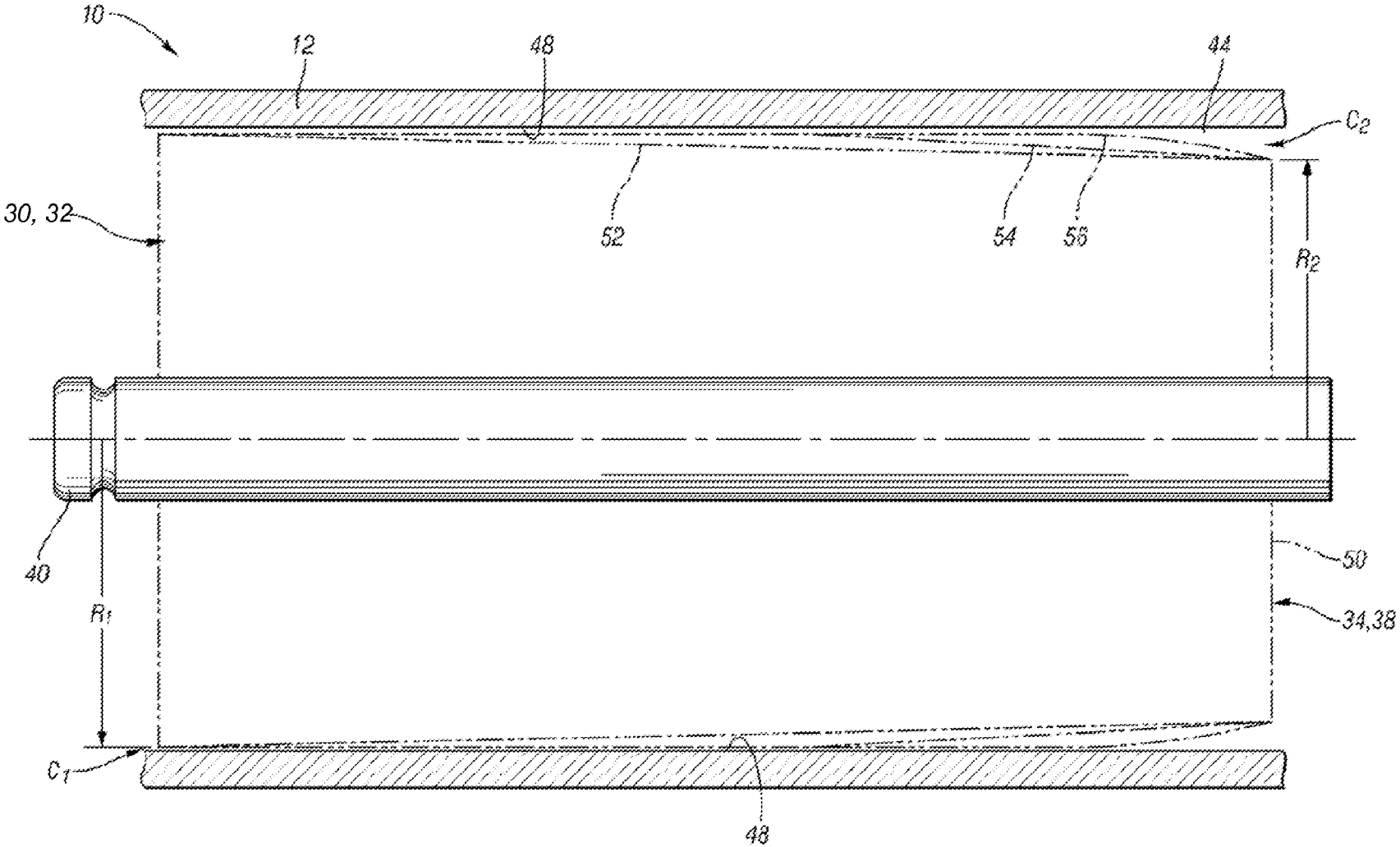
FIG. 4 is a sectional drawing illustrating the generally tapering profile of rotors contained within the supercharger assembly of FIG. 1.

Referring to FIG. 4 and with continued reference to FIGS. 1 through 3, there is shown a sectional schematic view of the super charger assembly 10. The swept volume of the first and second rotor assemblies 22 and 24 is delineated by phantom lines and indicated at 50. The swept volume 50 illustrates first, second, and third profiles 52, 54, and 56, respectively. The first profile 52 illustrates a rotor shape tapering continuously from the first ends 30 and 32 to the second ends 34 and 38. The second profile 54 illustrates a rotor shape that generally tapers from a point between the first ends 30 and 32 and the second ends 34 and 38 to the second ends 34 and 38. Alternately, the third profile 56 illustrates a rotor shape tapering in a generally curved fashion toward the second ends 34 and 38.

By tapering the lobes 26 and 28 of the first and second rotor assemblies 22 and 24, improvements in the efficiency of the supercharger assembly 10 may be achieved such as, for example, increase in the flow of intake air 16, reduced temperature rise of the intake air 16 flowing through the supercharger assembly 10, reduced parasitic losses, and improved resistance to scuff. Those skilled in the art will recognize that lobes 26 and 28 having a curved taper to optimally fit the thermal growth pattern of the first and second rotor assemblies 22 and 24 may be may be employed while remaining within the scope of that which is claimed.

While the best modes for carrying out the invention have been described in detail, those familiar with the art to which this invention relates will recognize various alternative designs and embodiments for practicing the invention within the scope of the appended claims.

The invention claimed is:

1. A rotor apparatus for a compressor assembly having a housing defining an inlet port, outlet port, and a rotor cavity in communication with the inlet port and outlet port, the rotor apparatus comprising:

first and second rotors each having a respective plurality of lobes formed thereon and rotatably mountable adjacent one another within the rotor cavity of the housing;

wherein each of said first and second rotors has a respective first end substantially adjacent to the inlet port and a respective second end substantially adjacent to the outlet port when mounted within the housing;

wherein each of said plurality of lobes has a respective outer radius; and wherein said outer radius $R_1$ of each of said plurality of lobes at said first end is greater than said outer radius $R_2$ of each of said plurality of lobes at said second end when said first and second rotors are mounted within the housing;

wherein said respective outer radius $R_1$, $R_2$ of each of said plurality of lobes and said housing define a respective clearance $C_1$, $C_2$ therebetween that is greater at said second end than at said first end when said first and second rotors are mounted within said housing;

wherein the clearance between each of the lobes of said first and second rotors and said housing as provided by said outer radius $R_2$ of each of said lobes at said respective second end of said first and second rotors is said clearance $C_2$.

2. The rotor apparatus of claim 1, wherein said outer radius generally tapers from said first end to said second end.

3. The rotor apparatus of claim 1, wherein said outer radius generally tapers from a point between said first and second end to said second end.

4. The rotor apparatus of claim 1, wherein the compressor assembly is a supercharger for an internal combustion engine.

5. The rotor apparatus of claim 1, wherein the clearance between each of the lobes of said first and second rotors and said housing as provided by said outer radius $R_1$ of each of said lobes at said respective first end of said first and second rotors is said clearance $C_2$.

6. The rotor apparatus of claim 1, wherein said respective outer radius $R_2$ of each of said plurality of lobes at said second end of said first rotor and said respective outer radius $R_2$ of each of said plurality of lobes at said second end of said second rotor is said outer radius $R_2$.

7. A compressor assembly comprising:

a housing defining an inner wall, an inlet port and an outlet port;

wherein said housing further defines a rotor cavity in communication with said inlet port and said outlet port;

first and second rotors each having a respective plurality of lobes formed thereon;

wherein said first and second rotors are rotatably supported within said rotor cavity and adjacent to said inner wall when mounted in said housing;

wherein said first and second rotors are interleaved and counter rotating;

wherein said first and second rotors have a respective first end substantially adjacent to the inlet port and a respective second end substantially adjacent to the outlet port when mounted within said housing;

wherein each of said plurality of lobes of said first and second rotors have a respective outer radius;

wherein said outer radius $R_1$ of each of said plurality of lobes at said first end is greater than said outer radius $R_2$ of each of said plurality of lobes at said second end when said first and second rotors are mounted within the housing;

wherein said outer radius $R_2$ of each of said plurality of lobes of said first and second rotors has greater clearance $C_2$ from said housing at said respective second end of said first and second rotors than said outer radius $R_1$ of each of said plurality of lobes of said first and second rotors has clearance $C_1$ from said housing at said respective first end of said first and second rotors when said first and second rotors are mounted within the housing; and wherein said inner wall is configured to define a gap $C_2$ between said inner wall and said outer radius $R_2$ of each of said plurality of lobes of said first and second rotors at said second end of said first and second rotors.

8. The compressor assembly of claim 7, wherein said outer radius generally tapers from said first end of said first and second rotors to said second end of said first and second rotors.

9. The compressor assembly of claim 7, wherein said outer radius generally tapers from a point between said first end of said first and second rotors and said second end of said first and second rotors to said second end of said first and second rotors.

10. The compressor assembly of claim 7, wherein the compressor assembly is a supercharger assembly for an internal combustion engine.

11. The compressor assembly of claim 7, wherein said inner wall is configured to define a gap $C_1$ between said inner wall and said outer radius $R_1$ of each of said plurality of lobes of said first and second rotors at said first end.

12. The compressor assembly of claim 7, wherein said respective outer radius $R_2$ of each of said plurality of lobes of said first rotor and said respective outer radius $R_2$ of each of said plurality of lobes of said second rotor at their respective second end is said outer radius $R_2$.

13. A compressor assembly comprising:

a housing defining an inlet port and outlet port;

wherein said housing includes an inner wall defining a rotor cavity in communication with said inlet port and said outlet port;

first and second rotors having a respective plurality of lobes formed thereon;

wherein said plurality of lobes have tip portions spaced from said inner wall and defining a gap therebetween;

wherein said first and second rotors are rotatably supported within said rotor cavity;

wherein said first and second rotors are interleaved and counter rotating;

wherein said first and second rotors have a respective first end substantially adjacent to the inlet port and a respective second end substantially adjacent to the outlet port when said first and second rotors are mounted in said housing;

wherein said gap $C_2$ is greater at said respective second end of said first and second rotors than said gap $C_1$ at said respective first end of said first and second rotors; and wherein said gap between said inner wall and each of said tip portions of said first and second rotors at said respective second end is said gap $C_2$.

14. The compressor assembly of claim 13, wherein said tip portions define an outer radius and wherein said outer radius is greater at said first end of said first and second rotors than at said second end of said first and second rotors.

15. The compressor assembly of claim 14, wherein said outer radius generally tapers from said first end of said first and second rotors to said second end of said first and second rotors.

16. The compressor assembly of claim 14, wherein said outer radius generally tapers from a point between said first end of said first and second rotors and said second end of said first and second rotors to said second end of said first and second rotors.

17. The compressor assembly of claim 13, wherein the compressor assembly is a supercharger assembly for an internal combustion engine.

18. The compressor assembly of claim 13, wherein said gap between said inner wall and each of said tip portions of said first and second rotors at said respective first end is said gap $C_1$.

19. The compressor assembly of claim 13, wherein said respective outer radius $R_2$ of each of said plurality of lobes at said second end of said first rotor and said respective outer radius $R_2$ of each of said plurality of lobes at said second end of said second rotor is said outer radius $R_2$.

20. The compressor assembly of claim 13, wherein said respective outer radius $R_1$ of each of said plurality of lobes at said first end of said first rotor and said respective outer radius $R_1$ of each of said plurality of lobes at said first end of said second rotor is said outer radius $R_1$.

* * * * *